US007119654B2

(12) United States Patent
Losbichler

(10) Patent No.: US 7,119,654 B2
(45) Date of Patent: Oct. 10, 2006

(54) TEMPERATURE SENSOR

(75) Inventor: Paul Losbichler, Vienna (AT)

(73) Assignee: Electrovac, Fabrikation elektrotechnischer Spezialartikel Gesellschaft m.b.H., Klosterneuburg (AT)

( * ) Notice: Subject to any disclaimer, the term of this patent is extended or adjusted under 35 U.S.C. 154(b) by 297 days.

(21) Appl. No.: 10/798,141

(22) Filed: Mar. 10, 2004

(65) Prior Publication Data

US 2004/0178878 A1 Sep. 16, 2004

(30) Foreign Application Priority Data

Mar. 10, 2003 (AT) ..... A 362/2003

(51) Int. Cl.
*H01H 37/48* (2006.01)

(52) U.S. Cl. ..... 337/394; 337/382; 337/393; 337/398; 219/448.19; 219/512

(58) Field of Classification Search ..... 337/393–394, 337/382, 398; 219/448.19, 512
See application file for complete search history.

(56) References Cited

U.S. PATENT DOCUMENTS

| | | | | |
|---|---|---|---|---|
| 4,008,454 | A * | 2/1977 | Bowling | 337/386 |
| 4,164,642 | A * | 8/1979 | Ebert | 392/432 |
| 4,577,176 | A * | 3/1986 | Bayer | 337/394 |
| 4,665,307 | A * | 5/1987 | McWilliams | 219/448.19 |
| 4,886,070 | A * | 12/1989 | Demarest | 600/488 |
| 5,032,818 | A * | 7/1991 | Zanon et al. | 337/319 |
| 5,036,236 | A * | 7/1991 | Wilson | 310/90.5 |
| 5,310,993 | A * | 5/1994 | McWilliams et al. | 219/448.19 |
| 5,390,542 | A * | 2/1995 | O'Rourke | 73/269 |
| 6,304,165 | B1 * | 10/2001 | Petri et al. | 337/394 |

FOREIGN PATENT DOCUMENTS

| | | |
|---|---|---|
| EP | 0 141 923 | 5/1985 |
| EP | 0 552 860 A2 | 8/1993 |
| EP | 0 993 015 A2 | 4/2000 |

* cited by examiner

*Primary Examiner*—Michael Datskovsky
*Assistant Examiner*—Robert J. Hoffberg
(74) *Attorney, Agent, or Firm*—Henry M. Feiereisen

(57) ABSTRACT

A temperature sensor for radiant heating units with a heating coil disposed in a cup includes a tube with a first end connected to a housing of a switch with a movable contact cooperating with stationery contacts in the housing. A two-section rod, which extends into the housing of the switch and operates the movable contact, is supported inside the tube. The tube and the rod have different thermal expansion coefficients. To prevent a shift in the switching point, the section of the rod that operates the contact terminates outside the hollow space of the cup, and the temperature-induced length changes of this section and of the housing are matched to each other.

9 Claims, 2 Drawing Sheets

TEMPERATURE SENSOR

CROSS-REFERENCES TO RELATED APPLICATIONS

This application claims the priority of Austrian Patent Application Serial No. A 362/2003, filed Mar. 10, 2003, pursuant to 35 U.S.C. 119(a)–(d), the disclosure of which is incorporated herein by reference.

BACKGROUND OF THE INVENTION

The present invention relates to a temperature sensor, and more particularly to a temperature sensor for a radiant heating unit that can be used in a cooking stove.

A temperature sensor of this type is described, for example in European patent publication EP 0 141 923 B. Two separately controllable heating coils are arranged in a cup of the radiant heating unit. The cup has a wrap-around projection that extends from the bottom of the cup and separates the two heating coils. The temperature sensor has a tube that extends across both heating coils and a three-segment rod that is supported in the tube. The center section of the rod extends only across the region of the centrally located heating coil. The end faces of the two outer sections of the rod abut the center section of the rod and have a thermal expansion coefficient which corresponds at least to the thermal expansion coefficient of the surrounding tube. The tube is formed as one piece, whereas the thermal expansion coefficient of the center section of the rod is smaller than the thermal expansion coefficient of the surrounding tube.

In a different design, the thermal expansion coefficient of the center section of the rod is greater than the thermal expansion coefficient of the surrounding tube, and the outer sections of the rod have a thermal expansion coefficient that is no larger, and preferably smaller, than the thermal expansion coefficient of the surrounding tube.

With this arrangement, the exterior sections of the rod which are located in the regions of the outer heating coil, expand equally or more than the surrounding tube, which over-compensates the influence of the addible heating coil. The temperature sensor then measures essentially the temperature in the central region of the cup and hence the temperature in the region of the inner heating coil.

European patent publication EP 0141 923 B also describes a solution wherein the tube is likewise formed in three sections, and wherein the sections of the tube have essentially a one-to-one correspondence with the sections of the rod. The center section of the tube has here a greater thermal expansion coefficient than the outer sections of the tube; likewise, the outer sections of the rod have a greater thermal expansion coefficient than the center section of the rod. The outer sections of the tube and the rod, respectively, are arranged in the region of the outer heating coil. In this embodiment, the influence of the addible outer heating coil is also compensated.

With these conventional approaches, although the influence of the outer heating coil is compensated, the switching point of the temperature sensor is still shifted, because heat is necessarily transferred from the cup of the radiant heating unit into the heating space surrounding the radiant heating unit due to thermal conduction and radiation. The switch housing then also expands according to its thermal expansion coefficient and hence affects the switching point.

Conventional temperature sensors for radiant heating units with a continuous rod that is supported in a tube connected with a switch housing and extending into the switch housing also experience a noticeably drop in the switch actuation temperature when the switch housing heats up. Switch housings are mostly formed of steatite and are located outside the cup of the radiant heating unit. The switch actuation temperature therefore must be set high enough so as to sufficiently exceed the actual switch actuation temperature for a cold switch housing.

It would therefore be desirable and advantageous to provide a temperature sensor that does not require a disproportionate increase of the desired switch actuation temperature when the switch housing is cold, which obviates prior art shortcomings and is able to prevent an initial overshoot of the set cooking temperature.

SUMMARY OF THE INVENTION

According to one aspect of the present invention, a temperature sensor for a radiant heating unit, that is formed of a heating coil disposed in a cup and a plate covering the cup, includes a switch having a switch housing attached to the cup and stationary contacts affixed to the switch housing and at least one movable switching contact that cooperates with the stationary contacts. The temperature sensor further includes a rod having at least two sections, and a tube having two ends and extending in a direction essentially parallel to the plate through at least one thermally insulating wall of the cup into a hollow space formed between the cup and the plate. One end of the tube is connected with the switch housing and the other end of the tube is closed off and is operatively connected to a first of the at least two sections of the rod. A second section of the rod extends into the switch housing and operates the movable switching contact. The tube and the rod have different thermal expansion coefficients and the second section of the rod terminates outside the hollow space of the cup. The product of the thermal expansion coefficient of the second section of the rod and a length of the second section located in the switch housing is selected based on a product of the thermal expansion coefficient of the switch housing and a length of the switch housing between a side of the switch housing facing the cup and support members of the stationary switch contacts in a direction parallel to the rod.

With this approach, the thermal expansion of the switch housing can be taken into account so as to substantially or completely prevent a shift in the switching point of the switch due to the thermal expansion of the housing. The plate can be a ceramic plate or a steel plate which can form a cooking surface.

Furthermore, the heat produced in the cup that houses the radiant heating unit diffuses through the wall of the cup and enters the heating space of the stove with the cup, causing the heating space to heat up. More particularly, relatively high temperatures can be produced in the heating space when several radiant heating units are used in a heating space of the stove, especially when the stove is operating at full load, for example, when all radiant heating units of the stove are turned on. For safety reasons, the temperature in the heating space, or the temperature on the exterior wall of the stove facing, for example a kitchen wall, that is related to the temperature of the heating space, must not exceed a predetermined value.

According to an advantageous feature of the invention, the product of the thermal expansion coefficient of the second section of the rod and the length of the second section projecting into the switch housing can be selected to be smaller than the product of the thermal expansion coefficient of the switch housing and the length of the switch housing between the side of the switch housing facing the cup and the support members of the stationary switch contacts in the direction parallel to the rod. As a result, with a stove with several cooking locations and therefore several radiant heating units, the switching points of the individual temperature sensors can be matched to each other for conditions where the individual cooking locations are switched on successively. This can be done by separately selecting the thermal expansion coefficient of the section of the rod that extends into the switch housing, and the thermal expansion coefficient of the switch housing itself. With this proposed selection criteria for the thermal expansion coefficients, the effect caused by the thermal expansion of the switch housing can then be partially compensated and the switch can operate at lower temperatures when the temperature of the heating area is higher. This prevents an excessive increase in the temperature of the heating area and therefore also of the temperature of the exterior wall surface of the stove.

According to yet another advantageous feature of the invention, the product of the thermal expansion coefficient of the second section of the rod and the length of the second section projecting into the switch housing can be selected to be identical to the product of the thermal expansion coefficient of the switch housing and the length of the switch housing between the side of the switch housing facing the cup and the support members of the stationary switch contacts in the direction parallel to the rod. The housing and the second section of the rod can then be fabricated of the same material and the length of the second section of the rod can be selected to be essentially identical to the length of the switch housing between the side of the switch housing facing the cup and the support members of the stationary switch contacts in the direction parallel to the rod. With this approach, the influence of the thermal expansion of the switch housing can virtually be totally compensated. The radiant heating unit can then be controlled essentially independently of the temperature in the heating space where the radiant heating units are located.

According to still another advantageous feature of the invention, the at least two sections of the rod can have different heat absorption coefficients. The selection of a suitable heat absorption coefficient can affect the response time of the temperature sensor of the switch and hence also the switching point of the corresponding switch. The startup or heat-up performance of the corresponding radiant heating unit can then be readily optimized.

According to another advantageous feature of the invention, the heat absorption coefficients of the two sections of the rod can be readily adjusted by selecting suitable heat absorption coefficients which can be defined by surface features of the rod, such as the surface color, cross-sectional profiles and surface roughness of the rod. The heat absorption coefficient can also be adjusted by using different materials, viz. metals, alloys, ceramics, for example $Al_2O_3$, composite materials and others. In order to further tailor the heat absorption properties, these rod materials can be coated by layers of both thermally conducting and non-conducting materials. Furthermore, such coating may comprise a layered structure whereby it is preferred that the outer layer is electrically insulating.

According to yet another advantageous feature of the invention, the heat absorption coefficient of the second section of the rod can be matched to the heat absorption coefficient of the housing.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
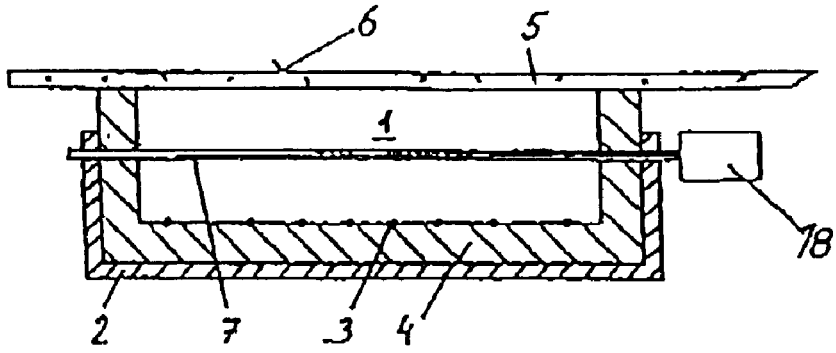
FIG. 1 shows schematically in a vertical cross-sectional view a heating space of a stove with a radiant heating unit.
Figure 2:
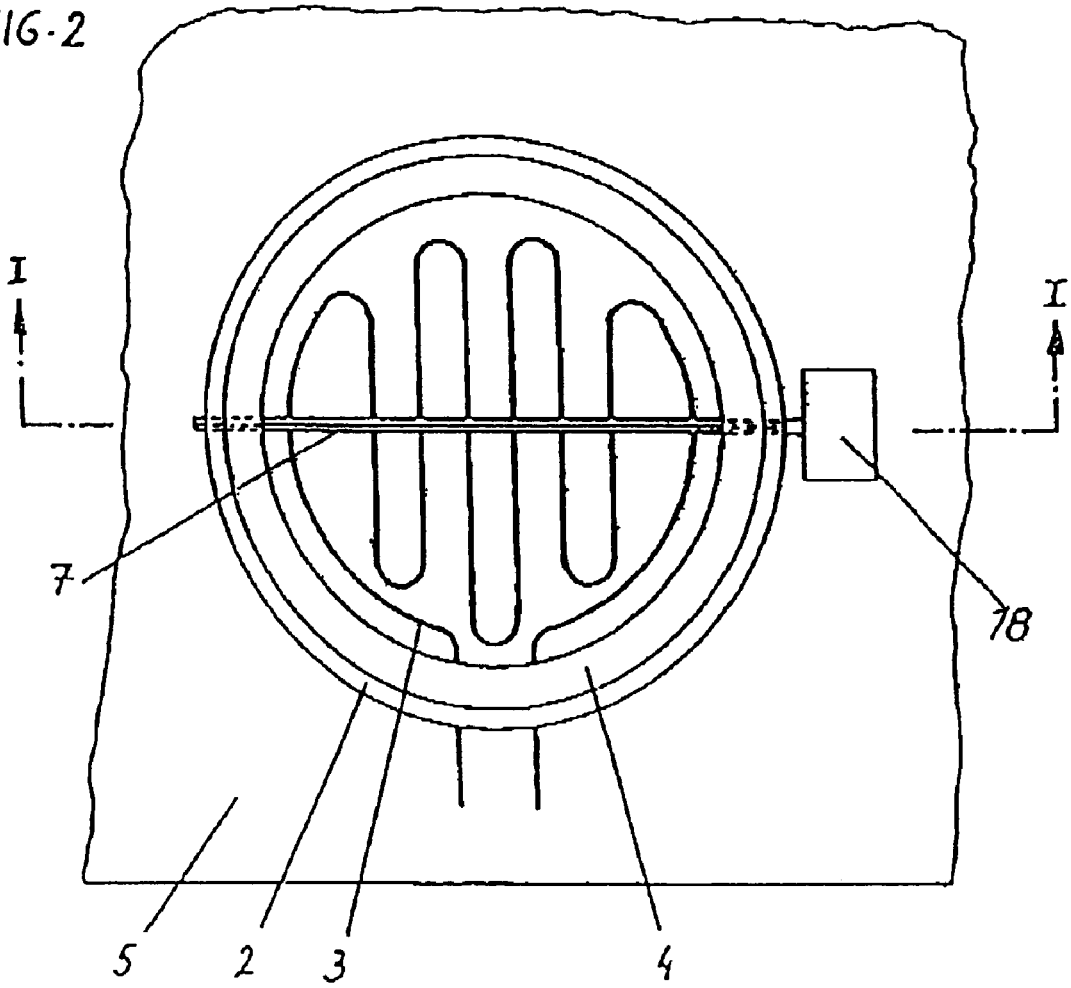
FIG. 2 is a top view of the radiant heating unit of FIG. 1.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a radiant heating unit 1 with a cup 2 that houses a heating coil 3. The heating coil 3 can be embedded in a thermally and electrically insulating medium 4. The radiant heating unit is arranged below a plate 5 that can be made of metal, glass ceramics or the like, and has a top surface defining a cooking surface 6. A temperature sensor 7 is arranged between the cooking surface 6 and the heating coil 3. The temperature sensor cooperates with a switching head 18 and extends through openings in an essentially cylindrical wall of the radiant heating unit 1 or the cup 2.

The temperature sensor 7 is therefore exposed to the temperature below the cooking surface 6, i.e., in the radiation space between the cooking surface 6, or the plate 5 supporting the cooking surface 6, and the heating coil, and can therefore measure this temperature.

Figure 3:
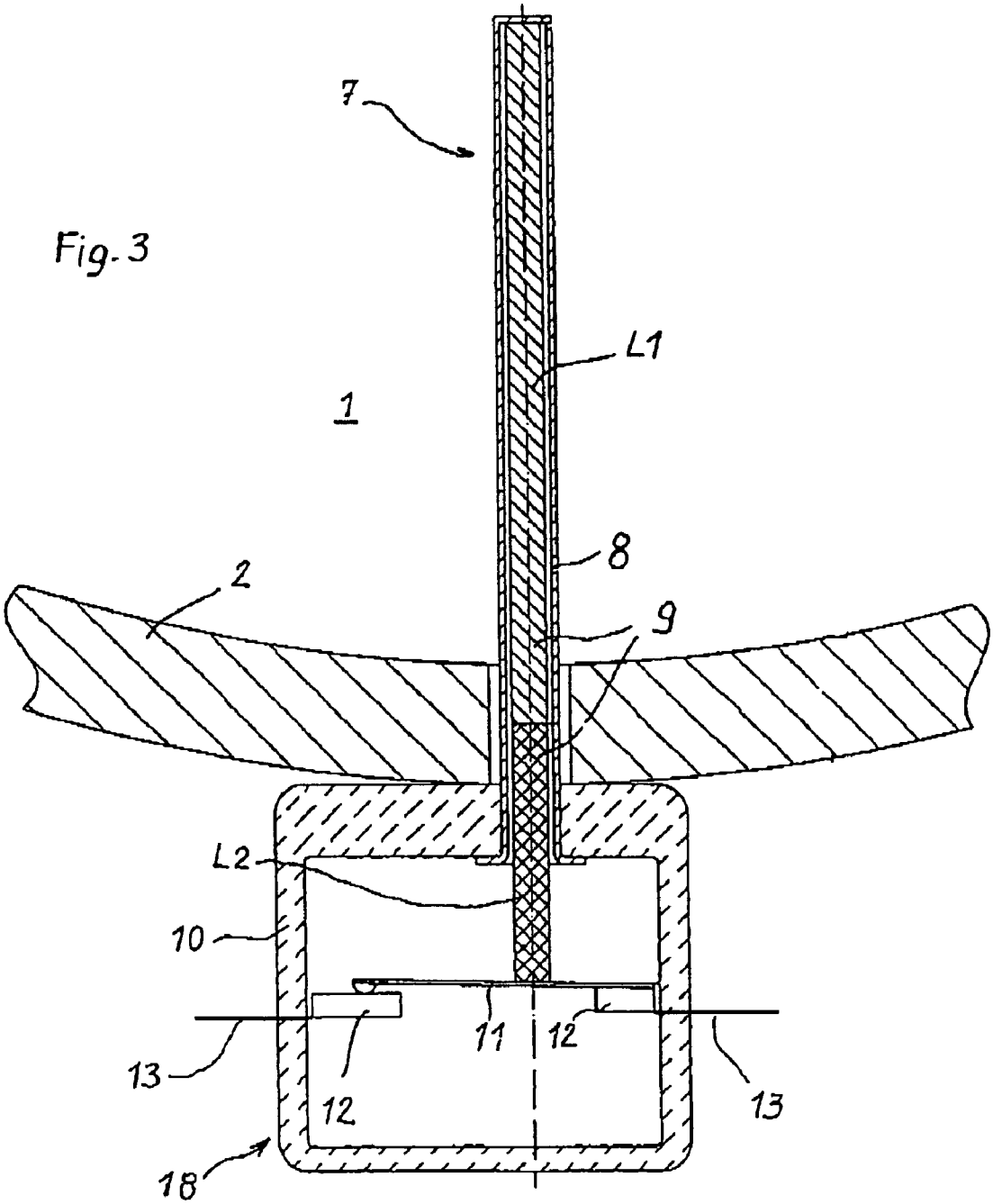
FIG. 3 shows schematically in an enlarged scale a temperature sensor according to the present invention.

Construction details of the temperature sensor 7 are shown in FIG. 3. Basically, the temperature sensor 7 includes an exterior tube 8 made of a material with a relatively large thermal expansion coefficient, such as a metal, in particular steel, and a two-section rod 9 that is held in the interior space of the tube 8. The two sections of the rod 9 are indicated in FIG. 3 with the reference characters L1 and L2. The temperature sensor 7 also includes a switch 18 located in a housing 10. The section L2 of the rod 9, which extends into the housing 10 of the switch 18, contacts a movable switching contact 11 of the switch 18 that is pre-biased so as to be open in its rest position. The fixed contacts of switch 18 are indicated with the reference character 12 and are connected to outside terminals 13.

One end of the tube 8 which can have any desired cross-section, is closed off, which can also be achieved with an adjustable holder (not shown) for the rod 9 or the rod section L1. When the temperature sensor 7 is installed, the section L1 of the rod 9 extends across the region of the radiant heating unit 1 in which the heating coil 3 is located. The second section L2 of the rod 9 is located in a region of the wall of the cup 2 made of a material with a poor thermal conductivity. The second section L2 extends into the housing 10 of the switch 18, which is located outside the radiant heating unit 1, but inside the heating space of the stove (not shown in detail), with the housing 10 being subjected to the temperature inside the heating space of the stove. The end face of the second section L2 contacts the section L1 of the rod.

The tube 8 of the temperature sensor 7 is fixedly connected with the housing 10 of the switch 18. When the heating coil 3 is switched on, the temperature sensor is exposed to the radiant heat from the heating coil, i.e., to the temperature in the radiant heating unit 1 between the heating coil 3 and the plate 5. As a result, the tube 8 which has a significantly greater thermal expansion coefficient than the section L1 of the rod 9, expands more than the section L1 of the rod, thereby decreasing the force onto the movable contact 11. When a corresponding temperature is reached, the pre-biased contact 11 opens and interrupts the current flow to the heating coil 3.

Since heat diffuses from the space of the radiant heating unit 1 through the wall of the cup 2, the heating space also heats up which also causes the housing 10 to heat up. The housing 10 expands according to its thermal expansion coefficient, which causes a corresponding displacement of the stationery contacts 12 of the switch relative to the end of tube 8 and consequently a shift in the switching point of switch 18.

In order to significantly reduce or even eliminate this effect, the section L2 of the rod 9 which extends into the housing 10 of the switch 18, has a thermal expansion coefficient which when multiplied by its length in the axial direction, produces a mathematical product with a value that can be selected depending on the value that is obtained when the thermal expansion coefficient of the housing 10 is multiplied by the length of the housing 10 taken along the rod 9 between the end of the housing 10 facing the wall of the cup 2 and the supports of the stationery contacts 12.

If these two products are selected to be identical, then the thermal expansion of the housing 10 is essentially completely compensated, so that the temperature increase of the housing 10 caused by the heat diffusing through the wall of the cup 2 has also essentially no effect on the thermal expansion behavior of the sensor rod extending to the heated cup.

However, if these two products are selected so that the product of the thermal expansion coefficient of the section L2 of the rod 9 that extends into the housing 10, is smaller than the product of the thermal expansion coefficient and the length of the housing between the end facing the cup 2 of the radiant heating unit and the supports of the stationery contacts 12 in the axial direction of the rod 9, then the switching point of the switch 18 shifts to lower temperatures with increasing housing temperature, assuming that the movable contact 11 of the switch 18 opens towards the tube 8.

In general, the movable contact 11 can also have a different configuration, for example, the contact 11 can be pre-biased so as to be closed in its rest position. In this case, the rod section L1 should have a greater thermal expansion coefficient than the tube 8 and the aforementioned products should be selected to have the opposite relationship for achieving the same effect.

It may be desirable to not entirely compensate the heating effect on the housing 10, for example, in order to ensure that the energy supplied to the radiant heating units and hence also to the heating space is reduced when the housing temperature increases, for example, by switching the radiant heating unit 1 off already at lower temperatures, for example, by opening switch 18. As mentioned above, an increase in the temperature of the housing 10 is associated with an increase in the temperature in the heating space of the stove, which also results in an increase in the exterior wall temperature of the stove.

The two sections L1, L2 of the rod 9 can also have different heat absorption coefficients, whereby the section L2 of the rod 9 preferably has a lower heat absorption coefficient. The lower heat absorption coefficient reduces heat absorption and consequently moderates the temperature increase of the rod 9, so that the temperature equilibrium with a housing is achieved at a later time.

In this way, the switching temperature is higher when the heater is switched on, i.e., when the housing of the radiant heating unit is cold, than the switching temperature at equilibrium temperature. The temperature sensor therefore overshoots when the housing is cold. This approach can optimize the startup performance, i.e., a higher glass temperature can be achieved in the cold state when the heater is switched on, which shortens the time required to reach the cooking temperature.

The heat absorption coefficients can be adjusted, for example, by selecting different colors, different surface features, such as using different surface profiles or a different surface roughness and the like, or by admixing different metals or other suitable materials, such as for example $Al_{2\ O3}$. The heat absorption coefficient can also be adjusted by using different materials, viz. metals, alloys, ceramics, for example $Al_2O_3$, composite materials and others. In order to further tailor the heat absorption properties, these rod materials can be coated by layers of both thermally conducting and non-conducting materials. Furthermore, such coating may comprise a layered structure whereby it is preferred that the outer layer is electrically insulating.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A temperature sensor for a radiant heating unit formed of a heating coil disposed in a cup and a plate covering the cup, comprising:

a switch having a switch housing attached to the cup and stationary contacts affixed to the switch housing and at least one movable switching contact that cooperates with the stationary contacts;

a rod having at least two sections; and a tube having two ends and extending in a direction essentially parallel to the plate through at least one thermally insulating wall of the cup into a hollow space formed between the cup and the plate, wherein one end of the tube is connected with the switch housing and the other end of the tube is closed off and is operatively connected to a first of the at least two sections of the rod, with a second of the at least two sections of the rod extending into the switch housing and operating the movable switching contact, wherein the tube and the rod have different thermal expansion coefficients, wherein the second section of the rod terminates outside the hollow space of the cup, and wherein the product of the thermal expansion coefficient of the second section of the rod and a length of the second section located in the switch housing is selected based on a product of the thermal expansion coefficient of the switch housing and a length of the switch housing between a side of the switch housing facing the cup and support members of the stationary switch contacts in a direction parallel to the rod, so that engagement between the at least one movable switching contact and the stationary contacts is substantially independent of thermal expansion of the switch housing.

2. The temperature sensor of claim 1, wherein the product of the thermal expansion coefficient of the second section of the rod and the length of the second section projecting into the switch housing is smaller than the product of the thermal expansion coefficient of the switch housing and the length of the switch housing between the side of the switch housing facing the cup and the support members of the stationary switch contacts in the direction parallel to the rod.

3. The temperature sensor of claim 1, wherein the product of the thermal expansion coefficient of the second section of the rod and the length of the second section projecting into the switch housing is equal to the product of the thermal expansion coefficient of the switch housing and the length of the switch housing between the side of the switch housing facing the cup and the support members of the stationary switch contacts in the direction parallel to the rod, and wherein the housing and the second section of the rod are fabricated of the same material and wherein the length of the second section of the rod is essentially equal to the length of the switch housing between the side of the switch housing facing the cup and the support members of the stationary switch contacts in the direction parallel to the rod.

4. The temperature sensor of claim 1, wherein the at least two sections of the rod have different heat absorption coefficients.

5. The temperature sensor of claim 4, wherein the heat absorption coefficients are defined by surface features of the rod, said surface features selected from the group consisting of surface coloration, cross-sectional profiles and surface roughness.

6. The temperature sensor of claim 4, wherein the heat absorption coefficients are adapted by adding a metal.

7. The temperature sensor of claim 4, wherein the heat absorption coefficients are adapted by addition of $Al_2O_3$.

8. The temperature sensor of claim 4, wherein the heat absorption coefficient of the second section of the rod is matched to a heat absorption coefficient of the housing.

9. The temperature sensor of claim 1, wherein the plate comprises a ceramic plate or a steel plate which form a cooking surface.

* * * * *